US008403238B2

(12) United States Patent
Hurtado

(10) Patent No.: US 8,403,238 B2
(45) Date of Patent: Mar. 26, 2013

(54) PORTABLE DECORATIVE WATERFALL FEATURE

(76) Inventor: Araceli Martinez Hurtado, Burleson, TX (US)

( * ) Notice: Subject to any disclaimer, the term of this patent is extended or adjusted under 35 U.S.C. 154(b) by 717 days.

(21) Appl. No.: 12/587,971

(22) Filed: Oct. 15, 2009

(65) Prior Publication Data

US 2011/0089254 A1 Apr. 21, 2011

(51) Int. Cl.
*F21S 8/00* (2006.01)

(52) U.S. Cl. ..... 239/20; 239/18; 239/23; 169/54; 126/500

(58) Field of Classification Search ..... 239/18, 239/20, 23, 289; 126/500; 169/54
See application file for complete search history.

(56) References Cited

U.S. PATENT DOCUMENTS 2,503,945 A * 4/1950 Grossniklaus ..... 119/247
4,560,007 A * 12/1985 Molloy et al. ..... 169/54
5,092,312 A * 3/1992 Zolow ..... 126/500
6,790,033 B2 9/2004 Grady et al.
6,901,925 B2 6/2005 Coughlin
7,175,424 B2 2/2007 Frink et al.
7,296,785 B2 * 11/2007 Hayden ..... 261/29
2003/0041855 A1 3/2003 Grady et al.
2003/0084897 A1 5/2003 Coughlin
2004/0261780 A1 12/2004 Frink et al.
2007/0023032 A1 * 2/2007 Wheeler ..... 126/500
2008/0308645 A1 12/2008 Presley et al.

* cited by examiner

*Primary Examiner* — Dinh Q Nguyen
(74) *Attorney, Agent, or Firm* — Lynn E. Barber

(57) ABSTRACT

A portable waterfall feature is provided for use on a fireplace having a mantle and a fireplace opening, and includes a water reservoir; tubing connectors and connectable tubing pieces, which may be assembled to extend upward from the water reservoir when the reservoir is placed at the bottom of the fireplace opening and around the one end of the mantle to be connected to a dispensing tubing piece connectable at the top of the mantle. A flexible curtain hangs down over the front of the mantle and in front of the fireplace opening over the water reservoir so that water that is pumped from the water reservoir flows upward through the assembled tubing pieces, is dispensed from the dispensing tubing piece along the top side of the flexible curtain; and flows down the flexible curtain and back into the reservoir.

12 Claims, 4 Drawing Sheets

PORTABLE DECORATIVE WATERFALL FEATURE

BACKGROUND OF THE INVENTION

1. Field of the Invention

This invention relates to waterfall features, and in particular, relates to a portable decorative waterfall feature that is designed to be installed in front of a fireplace.

2. Description of the Related Art

Many modern homes have fireplaces, even in climates in which there are many months when it is too warm and the fireplace is not comfortable to use. Most fireplaces are built into the house and require a substantial amount of space, limiting the amount of space available in the room for other decorative features. Fireplaces themselves are not easy to decorate or alter in appearance to add variety to a room. When the fireplace is not being used for a fire, especially for long periods, such as in the summer months during warmer weather, the homeowner may wish to have another point of interest in the same area of the room as the fireplace, but be limited because of the space taken up by the fireplace.

Many homeowners also enjoy having water features around and in the home. A number of inventors have endeavored to provide a water-feature to be positioned in fireplaces or near to fireplaces.

For example, the inventions in the patent and patent application of Coughlin (U.S. Pat. No. 6,901,925 and U.S. Patent Application 2003/0084897) allow viewing of the fire in a fireplace at the same time as a waterfall that is falling in front of the fireplace. As part of the fireplace there is a trough containing a plumbing assembly in front of or around the fire box of a fireplace and piping for passing water up to and though an opening in a hood positioned above the fire box. Nozzles are used to adjust the trajectory of the water.

The patent and patent application of Grady et al. (U.S. Pat. No. 6,790,033 and U.S. Patent Application 2003/0041855) provide a fireplace fountain in which liquid held in a basin is pumped through a supply tube to perforated tubing in a hood so that the liquid exits the perforated tubing and falls into the basin but not into a fire supported over the basin and under the hood.

The patent application of Wheeler (U.S. Patent Application No. 2007/0023032) provides a waterfall device that may be used independent of or in conjunction with a fireplace, and resembles a fireplace hearth comprising a mantel assembly with mantel columns having a shelf on them plus a base member. The waterfall system is disposed within the mantel columns for flowing and transporting water from a first compartment to a dispensing assembly.

In addition to the devices discussed above, there are also, various devices which combine fire and water, for example, U.S. Pat. No. 7,175,424 and U.S. Patent Application No. 2004/0261780 of Frink et al. (patio heater fire sculpture having the appearance of a twisting flame within a waterfall); and U.S. Patent Application No. 2008/0308645 of Presley et al. (a fire and water system with flowing water and a visible flame both within a support structure so that the fire and water are juxtaposed).

The prior fireplace-waterfall features are generally not portable at all or not easily portable. Many prior inventions essentially permanently convert a fireplace to a waterfall feature or permanently combine the two features.

It is therefore an object of the invention to provide a waterfall feature that is portable and may be used to temporarily convert the appearance of a fireplace to a decorative waterfall, bringing a relaxing and fresh environment to the room.

Other objects and advantages will be more fully apparent from the following disclosure and appended claims.

SUMMARY OF THE INVENTION

The invention herein is a portable waterfall feature for use on a fireplace having a mantle and a fireplace opening, and includes a water reservoir; an electrical submersible pump with light, tubing connectors and connectable tubing pieces, which may be assembled to extend upward from the water reservoir when the reservoir is placed at the bottom of the fireplace opening and around the one end of the mantle to be connected to a dispensing tubing piece connectable at the top of the mantle. A flexible curtain hangs down over the front of the mantle and in front of the fireplace opening over the water reservoir so that water that is pumped from the water reservoir flows upward through the assembled tubing pieces, is dispensed from the dispensing tubing piece along the top side of the flexible curtain; and flows down the flexible curtain and back into the reservoir.

Other objects and features of the inventions will be more fully apparent from the following disclosure and appended claims.

DETAILED DESCRIPTION OF THE INVENTION AND PREFERRED EMBODIMENTS THEREOF

The present invention is a portable waterfall feature for a fireplace having a mantle and an opening. Briefly, the waterfall feature comprises a water reservoir, an electrical submersible pump with light, a plurality of tubing connectors and tubing pieces, a dispensing tubing piece, and a flexible curtain. The proper assembly of the components of the waterfall feature as discussed herein is such that water pumped by the water pump from the water reservoir flows upward through the assembled tubing pieces, is dispensed from the dispensing tubing piece along the top side of the flexible curtain; and flows down the flexible curtain into the reservoir. The components of the waterfall feature of the invention can be fastened to a fireplace using commercially available fasteners, such as cable tie-downs, for example, or to a wood frame or other construction feature known in the art.

Figure 1:
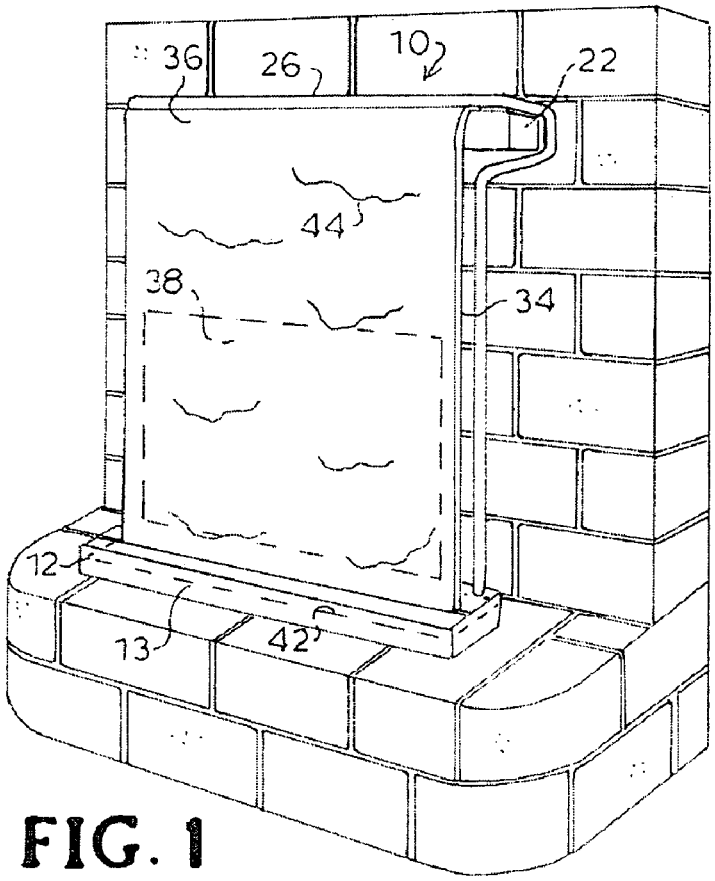
FIG. 1 is a perspective view of the assembled waterfall feature of the invention on a fireplace.

Referring now to the figures, as shown in FIG. 1, at the base of the waterfall feature 10 of the invention, is a water reservoir 12. Preferably, the water reservoir 12 is a pan made of a water-holding material selected from the group consisting of hard plastics such as high density polyethylene, metal such as copper or light gauge galvanized steel. If the water reservoir is made of metal or other material with seams or that is not waterproof, the water reservoir would be lined with a rubber bladder or the like as known in the art to prevent leakage. The water reservoir 12 needs to be sufficiently deep to hold the water for circulating through the system, and sufficiently long to extend at least the width of the fireplace opening. For a typical fireplace having an opening that is 42 inches wide, a rectangular reservoir 12 that is about 42 inches long by about eight inches wide with walls 13 about six inches high may be used, but other dimensions are of course available as desired. The water reservoir may have a flaps 43 (a front flap and a rear flap) hinged to the sides of the reservoir, primarily for decorative purposes. In use, the rear flap stays open to allow water to flow, and the front flap is down.

Figure 4:
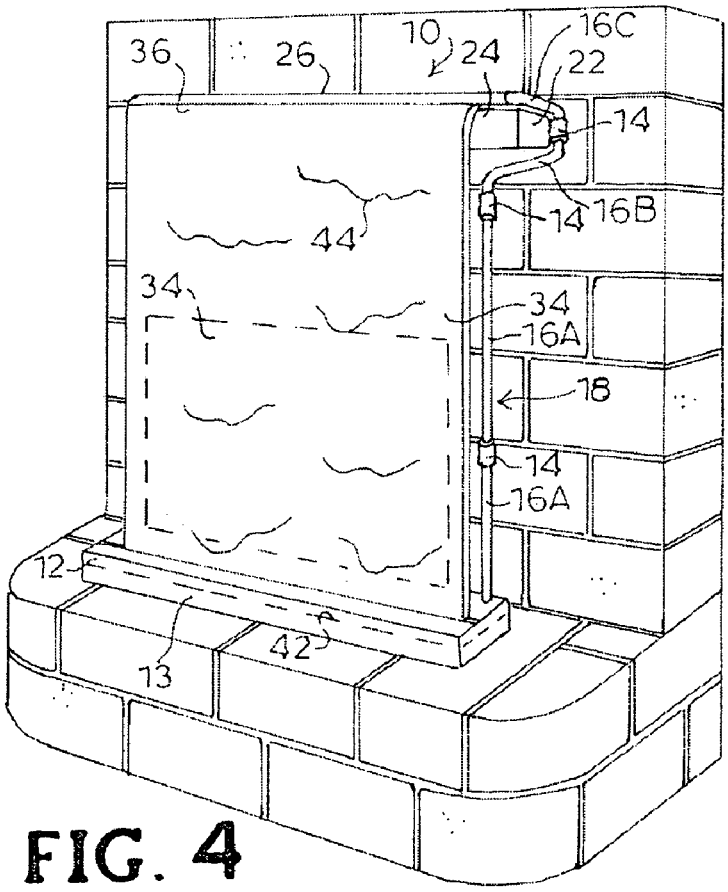
FIG. 4 is a perspective view of the assembled waterfall feature of the invention using multiple tubing pieces and tubing connectors.

Preferably the waterfall feature 10 is provided to consumers with a plurality of tubing connectors 14 and a plurality of connectable tubing pieces 16 as known in the art. The plurality of tubing connectors preferably contains straight and right-angle bend connectors 14 as shown in FIG. 4. While there may be a single tubing piece 15 fitted for a particular fireplace as shown in FIG. 1, this makes the unassembled waterfall feature 10 more bulky and limits the usefulness of the invention to the particular fireplace(s) for which a single tubing piece 15 of the appropriate length and with the bends at the appropriate place is provided. Therefore, preferably the connectable tubing pieces 16 are also provided in a sufficient variety of sizes and shapes so that a selection of the plurality of tubing pieces may be assembled and connected together in a variety of configurations to fit the various fireplaces with which they might be used.

Figure 2:
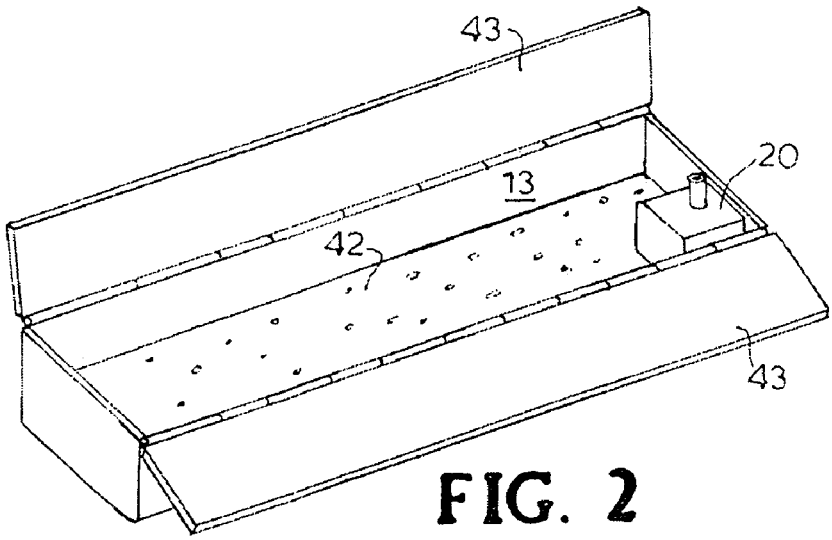
FIG. 2 is a perspective view of a water reservoir with an electrical submersible pump with light for use in the waterfall feature of the invention.
Figure 3:
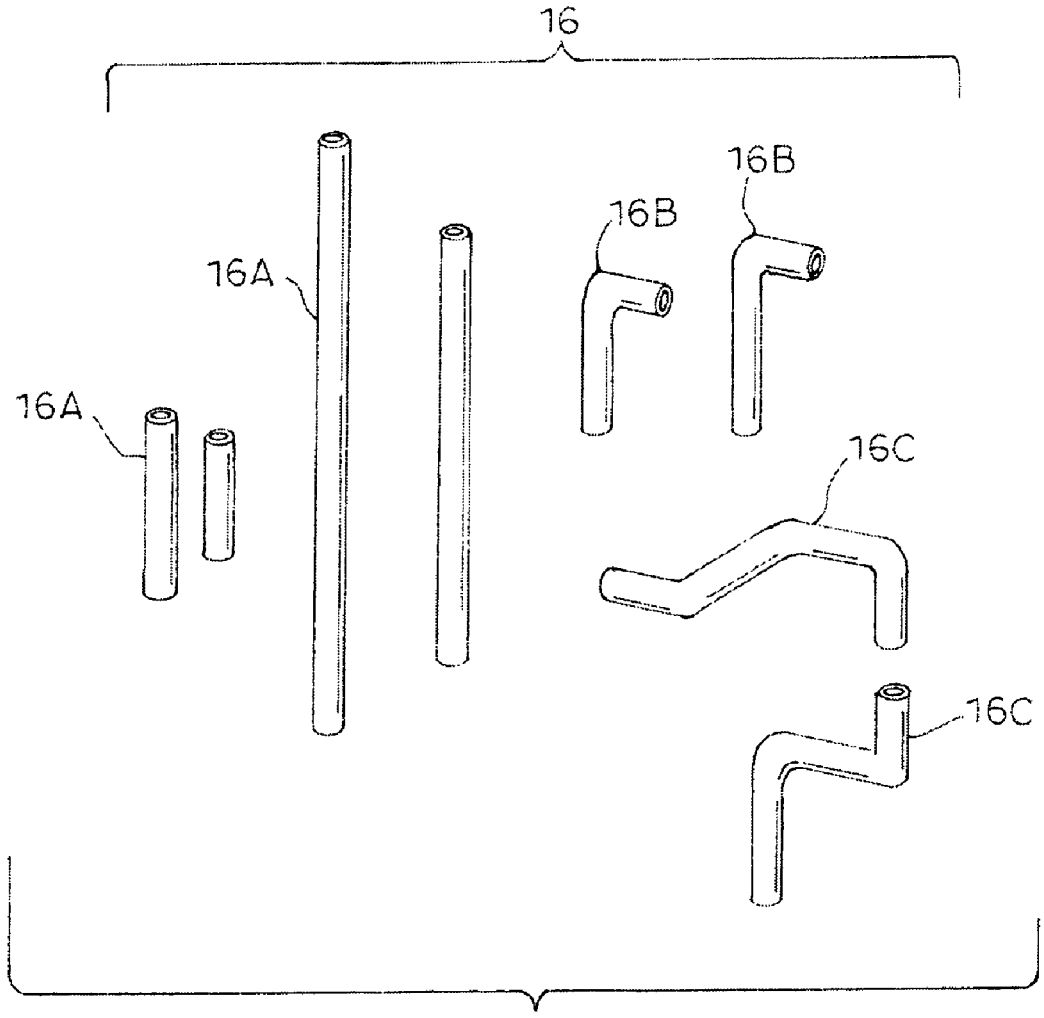
FIG. 3 is a perspective view of various tubing pieces that may be used in assembling the waterfall feature of the invention.

As shown in FIG. 3, this plurality of tubing pieces 16 thus preferably includes a variety of lengths of straight tubing 16A, various single bend tubing pieces 16B, and multiple-bend tubing pieces 16C. Together, as shown in FIG. 4, the tubing connectors 14 and the selected tubing pieces 16 allow the assembled, connecting tubing pieces 18 to extend upward from the pump 20 (which is shown in FIGS. 2 and 4) and water reservoir 12, when the water reservoir 12 is placed at the bottom of the fireplace opening 38, to beneath one end of the fireplace mantle 22, and around the one end of the mantle 22 to an open end 24 positioned at the top of the mantle 22. Preferably, the connectable tubing pieces 16 and tubing connectors 14 are made of PVC tubing, which preferably has an inner diameter of ⅛ inch to ¾ inch.

Figure 5:
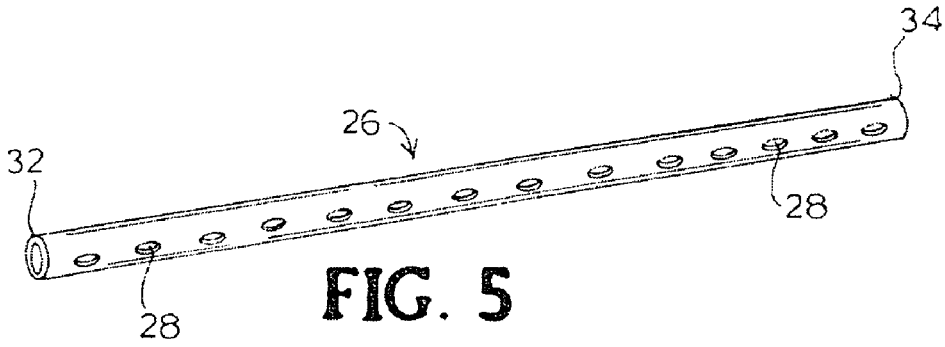
FIG. 5 is a side perspective view of the dispensing tubing piece of the invention.
Figure 7:
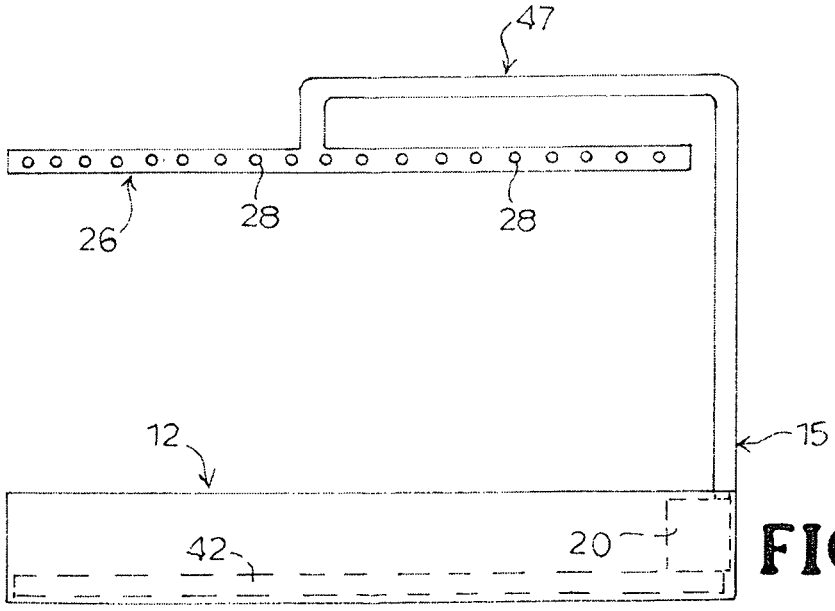
FIG. 7 is a front perspective view of the water delivery system of the invention.

The dispensing tubing piece 26 (FIG. 5) has a closed end 32 and an open end 24, which is connectable to open end 24 at the top of the mantle 22 by means of commercially available cable tie downs or masonry fasteners as known in the art. Preferably, the dispensing tubing piece 26 has perforations 28 so that water flows from the assembled tubing 18 into the dispensing tubing piece 26, through the perforations 28 and down the flexible curtain 34 when the water feature is assembled and the pump 20 is running. An alternative design to better direct the water flow evenly down the curtain is to run water supply tubing 47 to a central position on dispensing tube 26, as shown in FIG. 7 (curtain 34 not shown).

Figure 6:
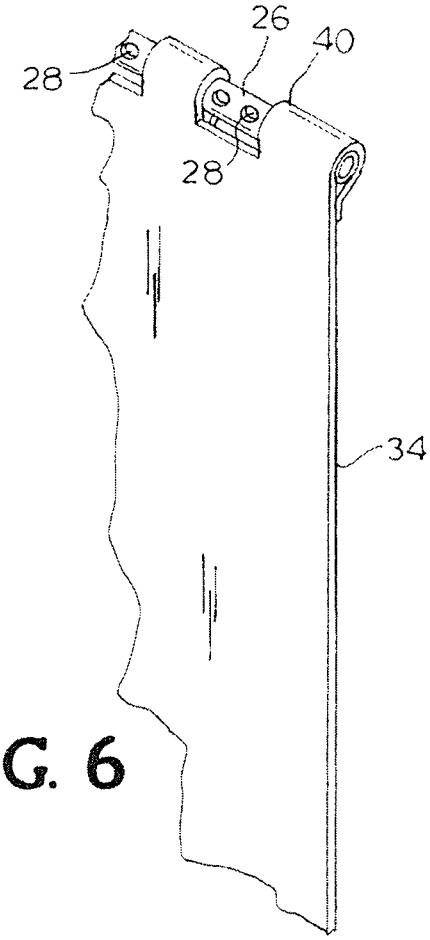
FIG. 6 is an end perspective view of the flexible curtain and sleeve into which the dispensing tube piece of the invention has been inserted.

The flexible curtain 34 has a top side 36 and a means of removable connection of the top side 36 to the dispensing tubing piece 26 so that the flexible curtain 34 hangs down over the front of the mantle 22 and in front of the fireplace opening 38 (shown by dashed lines in FIG. 1) and above the water reservoir 12 when the dispensing tubing piece 26 is placed across the top of the mantle 22. Preferably, the means of connection of the top side of the flexible curtain to the tubing pieces is a series of sleeve pieces 40 along the top side of the flexible curtain 34 through which sleeve 34, dispensing tubing piece 26 may be inserted similar to structures used to hang window curtains (FIG. 6). Alternatively, curtain 34 can be fused to dispensing tube 26 (not shown). In use, it is important that the length of the hanging flexible curtain 34 not touch the fireplace to avoid water running down the brickwork of the fireplace.

The flexible curtain 34 needs to be made of a material along which the water can run, and is preferably made of a material selected from the group consisting of print-on vinyl, plastic, and polyester film. Preferably, the flexible curtain 34 is decorated by means known in the art, for example, with a design being woven in or painted on, for example, with aquatic scenes. Preferably one or more additional flexible curtains 34 are provided having different appearances/decorations, so that the fireplace owner may be interchange them to provide a changed appearance to the waterfall feature 10.

The water pump 20 (FIG. 2) preferably is placed in the water reservoir 12, and is any standard pump known in the art of making fountains and the like. For example, a 80-90 GPH commercially available, electrical submersible pump, with light, such as made by Beckett Corporation (Norfolk, Va.) or Little Giant Pump Co. (Oklahoma City, Okla.) may be used. The light allows illumination of the flowing water enhances the esthetic appearance of the invention. Water from the water reservoir 12 is pumped by the water pump 20 up through the assembled tubing 18 shown in FIG. 4 (or through the single tubing piece 15 of FIG. 1), to the dispensing tubing piece 26 at the top of the mantle 22. Downward flowing water 44 (direction of flow shown by arrows in FIG. 4) then descends down the flexible curtain 34 and falls back into the water reservoir 12. Preferably the portable water feature of the invention also comprises a sponge 42 for placement in the water reservoir 12 extending the full length and width of the bottom of the reservoir for preventing water splash, or pea gravel may be placed in the reservoir.

While the preferred flexible curtain is rectangular and of a shape and size to completely cover the fireplace opening as shown, other shapes and sizes are possible. For different sizes of fireplace, different sized curtains are used. Thus, in addition to the standard model for standard fireplaces, the invention also includes shorter and longer curtains for shorter and taller fireplaces, respectively. The preferred flexible curtain is also opaque with a printed design, but it may be transparent or translucent.

Because the components of the portable waterfall feature of the invention may be assembled and disassembled as desired and are lightweight, the waterfall feature is both easily portable for assembly on the chosen fireplace when the fireplace is not going to be used as a fireplace, and is movable to a different fireplace, which may be a different size with a different size mantle.

Although the portable waterfall feature of the invention is designed for use on a fireplace, it is within the skill of one in the art to assemble it at another site in which a substitute structure for the mantle of a fireplace exists or can be constructed at a distance from a selected location for the water reservoir. This distance must be roughly the length of the flexible curtain; however it is within the skill of one in the art to provide curtains of variable length for such purposes or for different sizes of fireplace.

While the invention has been described with reference to specific embodiments, it will be appreciated that numerous variations, modifications, and embodiments are possible, and accordingly, all such variations, modifications, and embodiments are to be regarded as being within the spirit and scope of the invention.

What is claimed is:

1. A portable waterfall feature for a fireplace having a mantle with two ends, a front, a top, and a bottom, and an opening having a bottom, the waterfall feature comprising:

a) a water reservoir;

b) a plurality of tubing connectors and a plurality of connectable tubing pieces, wherein a selection of the plurality of tubing pieces may be assembled and connected together with the tubing connectors, so that the assembled, connected tubing pieces extend upward from the water reservoir when the reservoir is placed at the bottom of the fireplace opening, to beneath one end of the mantle, and around the one end of the mantle to tubing end at the top of the mantle;

c) a dispensing tubing piece connectable to the tubing end of the plurality of connectable tubing pieces at the top of the mantle;

d) a flexible curtain having a top side and a means of removable connection of the top side to the dispensing tubing piece so that the flexible curtain hangs down over the front of the mantle and in front of the fireplace opening over the water reservoir when the dispensing tubing piece is placed across the top of the mantle; and e) a water pump;

wherein water pumped by the water pump from the water reservoir flows upward through the assembled tubing pieces, is dispensed from the dispensing tubing piece along the top side of the flexible curtain; and flows down the flexible curtain into the reservoir, wherein the portable waterfall feature may be assembled and disassembled for use at other fireplaces.

2. The portable waterfall feature of claim 1, wherein the means of connection of the top side of the flexible curtain to the dispensing tubing piece is a sleeve along the top side of the flexible curtain through which sleeve, tubing may be inserted.

3. The portable water feature of claim 1, further comprising a sponge for placement in the water reservoir and for preventing water splash.

4. The portable water feature of claim 1, wherein the reservoir is a pan made of a material selected from the group consisting of high density polyethylene, copper and galvanized steel.

5. The portable water feature of claim 1, wherein the connectable tubing pieces comprise PVC tubing.

6. The portable water feature of claim 5, wherein the PVC tubing has a diameter of ⅛ inch to ¾ inch.

7. The portable water feature of claim 1, wherein the dispensing tubing piece has perforations so that water flows through the perforations and down the flexible curtain when the water feature is assembled and the pump is running.

8. The portable water feature of claim 1, wherein the water pump is placed in the water reservoir.

9. The portable water feature of claim 1, wherein the flexible curtain is made of a material selected from the group consisting of printed plastic and polyester film.

10. The portable water feature of claim 1, wherein the flexible curtain is decorated with aquatic scenes.

11. The portable water feature of claim 1, further comprising at least one additional flexible curtain having an appearance differing from the appearance of the flexible curtain of claim 1, which additional flexible curtain may be interchanged with the flexible curtain of claim 1 to provide a changed appearance to the waterfall feature.

12. The portable water feature of claim 1, wherein the pump further comprises a light.

* * * * *